US005826997A

United States Patent [19]

Coleman et al.

[11] Patent Number: 5,826,997

[45] Date of Patent: Oct. 27, 1998

[54] POP-EYE PEN AND CANDY HOLDER

[76] Inventors: Thomas J. Coleman, 19170 Paddock Pl., Abingdon, Va. 24211; William K. Schlotter, IV, 117 Wateredge La., Fredericksburg, Va. 22406; Princess Ann Coleman, 19170 Paddock Pl., Abingdon, Va. 24211; Ann M. Schlotter, 117 Wateredge La., Fredericksburg, Va. 22406

[21] Appl. No.: 848,222

[22] Filed: Apr. 29, 1997

[51] Int. Cl.[6] ..... B43K 29/00

[52] U.S. Cl. ..... 401/52; 401/195; D19/42

[58] Field of Search ..... 401/195, 52, 209; D19/42

[56] References Cited

U.S. PATENT DOCUMENTS

| | | | |
|---|---|---|---|
| D. 57,520 | 4/1921 | Fortune | D19/42 |
| D. 186,924 | 12/1959 | Lakatosh | D19/42 |
| D. 295,421 | 4/1988 | Young | 401/209 |
| 2,237,883 | 4/1941 | Lipic | 401/52 |
| 3,615,596 | 10/1971 | Petti et al. | 401/52 |
| 4,468,146 | 8/1984 | Tabachnik | D19/42 |
| 4,530,503 | 7/1985 | Rice | 401/195 |
| 5,190,388 | 3/1993 | Lee | 401/52 |
| 5,433,642 | 7/1995 | Chia | 401/195 |

FOREIGN PATENT DOCUMENTS

| | | | |
|---|---|---|---|
| 2219255 | 12/1989 | United Kingdom | 401/195 |

*Primary Examiner*—Charles R. Eloshway
*Attorney, Agent, or Firm*—Melvin A. Crane

[57] ABSTRACT

The pop-eye pen and candy holder includes a main housing made of plastic or any suitable material. Inside the main housing is a ballpoint pen with the writing point extending out of the lower end of the main housing. The upper end of the main housing has a holding socket for a plastic eyeball to sit upon. The plastic eyeball is surrounded by a liquid and both are contained within a clear plastic sphere. The plastic eyeball has an off-centered weight to allow movement within the clear plastic ball. The upper end of the main housing also has an aperture to secure one end of a plastic tubing that is wrapped around the plastic eyeball to hold the plastic eyeball in place and to allow enough space for movement of the sphere. The other end of the plastic tubing extends above the eyeball and has an aperture at the top to hold a candy lollipop that can be replaced. This combination is a toy, a candy and a pen that will provide children with lots of fun. The plastic eyeball can be removed and played with by popping the eyeball out from between the plastic tubing curves.

9 Claims, 1 Drawing Sheet

POP-EYE PEN AND CANDY HOLDER

This invention is directed to a pop-eye pen and candy holder and more particularly to a pop-eye pen including a plastic eyeball in combination with a lollipop holder and a ballpoint pen.

REFERENCE TO PRIOR ART

Applicants are not knowledgeable of any prior art except for U.S. Pat. No. 2,237,883 which is directed to an ornamental device which is adapted to be mounted onto a non-writing end of a ballpoint pen.

SUMMARY AND OBJECTS OF THE INVENTION

This invention sets forth a ballpoint pen which has a writing point fixed to extend from an end of the pen. The upper end of the pen has a holding socket for a spherical container which contains a plastic eyeball immersed in a fluid medium. The plastic eyeball has an off-centered weight which permits the eyeball to move within the spherical container. The spherical container is held in place in the holding socket by use of a plastic tubing which is wrapped around the spherical container and secured at one end to the main housing that contains the ballpoint pen. The upper end of the plastic tube has an aperture in the outer end into which an end of a lollipop stick extends to secure a lollipop to the plastic tubing.

It is therefore an object of the invention to provide a combination ballpoint pen, an eyeball which moves within a spherical container and a candy holder that also retains the spherical container within a holding socket.

Another object is to provide an off-centered weight on the eyeball to permit the eyeball to move within a fluid within the spherical container.

Still another object is to provide an eyeball retaining means which functions also to support a lollipop for use with the ballpoint pen and eyeball.

Other objects and advantages will become obvious from a more detailed description of the invention when considered with the drawings.

DETAILED DESCRIPTION

Figure 1:
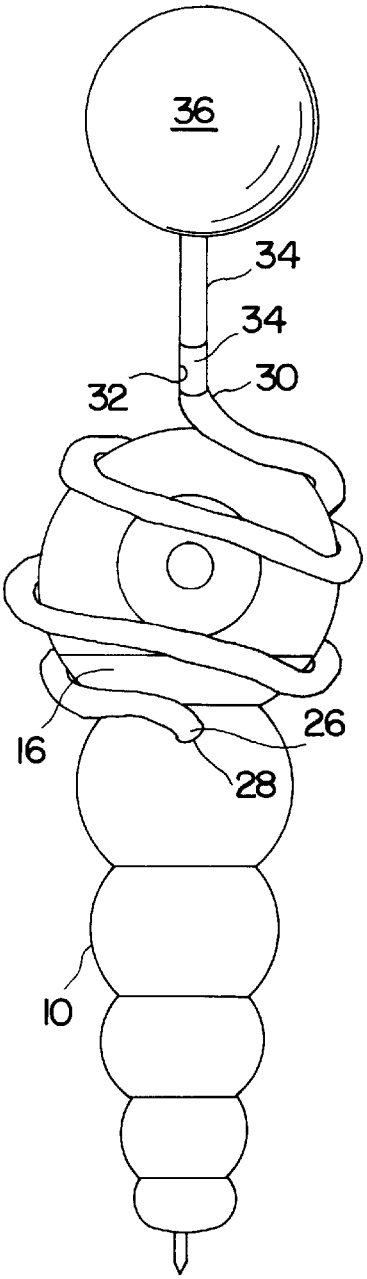
FIG. 1 is a front view of the device illustrating the relationship of the parts.
Figure 2:
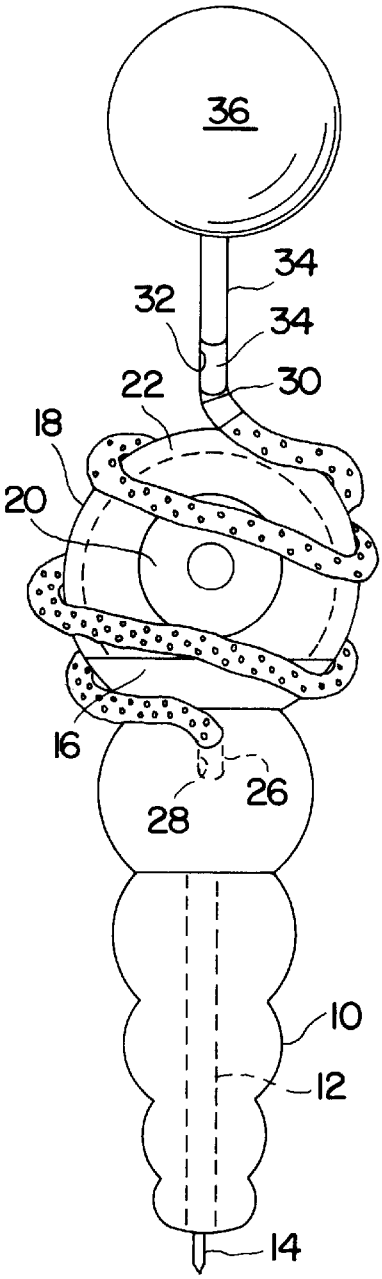
FIG. 2 is a view which illustrates the ballpoint pen in which the dotted lines indicate the end container.

Now, referring to the drawings wherein like reference characters represent like parts throughout the different drawings, in FIGS. 1 and 2, there is shown a main housing 10 which houses an ink reservoir 12 for the ballpoint pen which has a ballpoint 14. The main housing has a holding socket 16 which seats centrally on the main housing. The holding socket 16 forms a seat on its inner surface for an eyeball container 18 which houses an eyeball 20 which floats within a fluid 22 of a safe, non-harmful type. The spherical container is supported within the holding socket 16 by use of a clear plastic tubing 24. The clear plastic tubing has one end 26 that extends into an aperture 28 in the main housing just below the holding socket. The plastic tube is then wound or wrapped about the holding seat and the spherical container with an upper end 30 extending upwardly from the spherical container. The upper end 30 should be at least approximately on the axis of the main housing 10. The upper end of the plastic tube has an aperture 32 into which a lower end of a lollipop stick 34 extends. A lollipop 36 is shown on the upper end of the stick 34.

Figure 3:
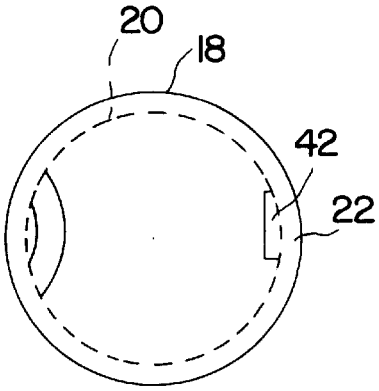
FIG. 3 is a side view of the eyeball contained in the spherical container illustrating the off-centered weight.

As shown in FIG. 3, the plastic eyeball 20 has an off-centered weight 42 to allow movement of the eyeball within the eyeball container 18.

The plastic tube could be plugged on the bottom end 26 and near the upper end at a point first below the end of the lollipop stick and a colored fluid could be added to the plastic tube so that it would look nice. Different colored floating particles 40 could be added to the plastic tube so that the particles will move about as the pen is used or during consuming the lollipop, such particles could include florescent and/or phosphorescent particles. The fluid used must be of a type that will not freeze and which would not be harmful to a person.

The main housing can be made of plastic or any other suitable type of material. The plastic can be clear, colored or multi-colored. The main housing could be decorated with different designs, pictures, characters, etc., to provide a nice aesthetic appearance.

The plastic tubing is not wound with the encircling parts too close together so that the eyeball container with the eyeball therein can be removed and used as a separate play toy. When not used as a separate play toy the eyeball container should be replaced in the socket by spacing the plastic tubing so that the eyeball container can be replaced into the holding socket.

The lollipop stick can be removed after consumption of the lollipop to avoid having the stick present by which someone could be injured. When offering the pop-eye pen and candy holder for sale, one or more of the lollipops could be packaged with the pop-eye pen as a separate part and the lollipop would be added at such time that the device is to be used.

The device should be made without any sharp points or surfaces so that a person cannot injure himself when playing with the device.

The ballpoint pen has a reservoir which is filled with ink, and when the ink has been used the device can be tossed aside or used strictly as a play toy because the ballpoint pen is not replaceable. However, if one wants to add the expense of making the ballpoint pen replaceable it could be done.

The foregoing relates to preferred exemplary embodiments of the invention, it being understood that other variants and embodiments thereof are possible within the spirit and scope of the invention, the latter being defined by the appended claims.

What is claimed is:

1. A pop-eye pen and lollipop holder which comprises, a main body, said main body housing a ballpoint pen, said ballpoint pen having a writing point for extending from one end of said main body, a plastic eyeball assembly seated on an upper end of said main body, means for securing said plastic eyeball assembly on said upper end of said main body, means extending from said upper end of said main body for holding one end of a lollipop stick;

a holder socket secured to said upper end of said main body in which said plastic eyeball assembly is seated; and, said means for securing said plastic eyeball assembly is a plastic tube which is wrapped about said plastic eyeball assembly and said socket.

2. A pop-eye pen and lollipop holder as set forth in claim 1, in which, said means for holding said lollipop on said upper end of said main body is an end of said plastic tube.

3. A pop-eye pen and lollipop holder as set forth in claim 2, in which, said plastic eyeball assembly includes a spherical container, a plastic eyeball within said spherical container, a fluid which surrounds said plastic eyeball which floats within said fluid, and an off-center weight on said plastic eyeball which permits movement of said plastic eyeball within said container.

4. A pop-eye pen and lollipop holder as set forth in claim 3, in which, said plastic tube is plugged at least near each end and contains a fluid therein which contains small particles of different colors.

5. A pop-eye pen and lollipop holder as set forth in claim 3, in which, said plastic tube is plugged at least near each end and contains a fluid therein in which small particles of florescent or phosphorescent material are contained in said fluid.

6. A pop-eye pen and lollipop holder as set forth in claim 1, in which, said plastic eyeball assembly includes a spherical container, a plastic eyeball within said spherical container, a fluid which surrounds said plastic eyeball which floats within said fluid, and an off-center weight on said plastic eyeball which permits movement of said plastic eyeball within said container.

7. A pop-eye pen and lollipop holder as set forth in claim 1, in which, said plastic tube is plugged at least near each end and contains a fluid therein which contains small particles of different colors.

8. A pop-eye pen and lollipop holder as set forth in claim 1, in which, said plastic tube is plugged at least near each end and contains a fluid therein in which small particles of florescent or phosphorescent material are contained in said fluid.

9. A pop-eye pen and lollipop holder which comprises, a main body, said main body holding a pen, a plastic eyeball assembly seated on an upper end of said main body, means for securing said plastic eyeball assembly on said upper end of said main body, means extending from said upper end of said main body for holding one end of a lollipop stick;

a holder socket secured to said upper end of said main body in which said plastic eyeball assembly is seated; and said means for securing said plastic eyeball assembly is a plastic tube which is wrapped about said plastic eyeball assembly and said holder socket.

* * * * *